US006371254B1

(12) United States Patent
Koshak

(10) Patent No.: US 6,371,254 B1
(45) Date of Patent: Apr. 16, 2002

(54) JACK ARRESTOR

(76) Inventor: John W. Koshak, 1809 Versailles Ave., Alameda, CA (US) 94501

( * ) Notice: Subject to any disclaimer, the term of this patent is extended or adjusted under 35 U.S.C. 154(b) by 0 days.

(21) Appl. No.: 08/540,323

(22) Filed: Oct. 6, 1995

(51) Int. Cl.[7] ..... B65H 59/10
(52) U.S. Cl. ..... 188/67; 187/272
(58) Field of Search ..... 188/67, 82.3, 82.7; 187/272

(56) References Cited

U.S. PATENT DOCUMENTS

| | | | | |
|---|---|---|---|---|
| 3,571,865 A | * | 3/1971 | Johnson | 188/67 |
| 3,783,976 A | | 1/1974 | Kerr | 187/8.45 |
| 3,783,983 A | | 1/1974 | McNally et al. | 188/189 |
| 3,942,607 A | | 3/1976 | Sobat | 187/77 |
| 3,995,534 A | | 12/1976 | Rastetter | 92/27 |
| 4,007,815 A | * | 2/1977 | Acre | 188/67 X |
| 4,306,339 A | * | 12/1981 | Ward | 188/67 |
| 4,449,615 A | | 5/1984 | Beath et al. | 188/67 |
| 4,638,888 A | | 1/1987 | Coy | 187/19 |
| 4,715,456 A | * | 12/1987 | Poe, Jr. et al. | 188/67 X |
| 5,052,523 A | | 10/1991 | Ericson | 187/89 |

FOREIGN PATENT DOCUMENTS

| | | |
|---|---|---|
| GB | 905929 | 9/1962 |
| GB | 1555486 | 11/1979 |

* cited by examiner

*Primary Examiner*—S. Joseph Morano
*Assistant Examiner*—Mariano Sy
(74) *Attorney, Agent, or Firm*—James J. Leary; Carol D. Titus

(57) ABSTRACT

An arrestor for any hydraulic ram or other cylinder but primarily for an emergency brake for lifting elevators. The present invention is a jack arrestor utilizing two lever acting brake arms lined with an accretable metal as the friction material. When actuated, the brake arms contact the ram circumferentially to slow and stop the falling ram. The lining material is machined inside the brake arms to a diameter slightly less than the diameter of the ram and when actuated, the accretable material on the brake arms contacts the ram with sufficient frictional force to stop the downward motion of the ram. The safety brake may be actuated by loss of hydraulic pressure, by an electronic signal from a hydraulic pressure detector, by down overspeed or by an uncontrolled down motion detector. In the case of the hydraulic pressure detector, reapplication of normal pressure in the hydraulic cylinder will automatically reset the brake.

16 Claims, 3 Drawing Sheets

JACK ARRESTOR

BACKGROUND OF THE INVENTION

1. Field of Invention

The present invention relates generally to safety brakes for hydraulic jacks or rams. In particular the present invention relates to a hydraulic ram lifting elevator emergency arrestor using a lever and lock mechanism to provide braking action without permanently damaging or destroying the hydraulic ram.

2. Description of the Prior Art

The present invention relates to a hydraulic ram arrestor using a lever lock type of mechanism which is activated by a pressure failure condition, down overspeed, or uncontrolled down motion. When activated, two lever acting brake arms are dropped into contact with the elevator ram, the resulting friction bringing the elevator to a sliding stop.

There have been numerous brake systems developed for stopping hydraulic ram elevators during emergency situations. All of the prior art patents found were directed toward collets or brake shoes, that, during a hydraulic pressure failure, would drop down and wedge in between a fixed housing and the ram of the elevator. The friction generated by the downward motion of the ram in contact with the collet or brake shoe causes the collet or brake shoe to be driven downwardly, thereby wedging the ram to a halt. Empirical evidence indicates that the force necessary to stop an elevator using such a brake exceeds the elastic limit of the material used in commercial rams causing the ram to be deformed into an hourglass shape at the point where such brakes grip the ram. This type of damage to the ram cannot be repaired and instead, expensive and time consuming replacement is required to restore the elevator to working condition. The prior art patents also disclosed elevator brakes that have many moving parts, and are correspondingly complex. Additionally, the prior art devices appear relatively large and bulky. Size is an important consideration because there is often limited space into which to fit a braking device. Therefore, it is desirable for the brake to have a low profile, thereby facilitating installation in all present hydraulic elevators.

As a specific example of a prior art design having the above mentioned short comings, Beath et al., U.S. Pat. No. 4,449,615 is a floor mounted lever-actuated wedge device. The many components in this design complicate it by comparison to the present invention. Beath uses collets, that, during a hydraulic pressure failure, drop down and wedge in between a fixed housing and the ram of the elevator. The friction generated by the downward motion of the ram in contact with the collets causes the collets to be driven downward, thereby wedging the ram to a halt. The force necessary to stop an elevator using the brake disclosed in Beath exceeds the elastic limit of the material used in commercial rams causing the ram to be deformed into an hourglass shape at the point where the collets grip the ram. Additionally, the above mentioned patent does not precisely show relation to the top of the cylinder and the bottom of the elevator. However, it appears too tall to fit most existing elevator systems.

In light of the problems listed above and exemplified by U.S. Pat. No. 4,449,615, a new elevator brake is needed that can safely stop a fully loaded elevator without permanently damaging the ram.

The present invention, using an accretable metal or other adherent material to apply a braking force to the ram is a clear improvement over the prior art. Prototype testing has shown that copper bar formed to shape has yielded sufficiently high braking force, with and without the presence of oil on the surface of the ram. Several materials have been tested, and, to date, copper has been the best material for the purpose. The present invention is also comparatively simple and low in profile facilitating installation on current elevator designs.

SUMMARY OF THE INVENTION

The general object of the present invention is to provide a mechanism for arresting an elevator which can safely stop a fully loaded elevator without permanently damaging any part of the elevator.

It is another object of the present invention to provide an elevator arrestor that allows the elevator to be usable within a short period of time with little reset and repair necessary. Optimally, the reset and repair should be a relatively simple and inexpensive procedure.

It is a further object of the present invention to provide an arrestor that will fit within a small vertical space such that it can fit within the normal design parameters for hydraulic ram elevators, and may also be retrofit into existing hydraulic ram elevators.

It is yet another object of the present invention to provide a system that can be easily installed and requires very little down time in which the elevator is non-functional.

It is an additional object of the present invention to provide for an arresting system that is inexpensive to manufacture.

The present invention is a hydraulic safety arrestor for slowing and stopping a ram, jack or other cylinder type object. It utilizes two lever acting brake arms lined with an accretable metal as the friction material. When actuated, the brake arms contact the ram circumferentially to slow and stop the falling ram. The lining material is machined inside the brake arms to a diameter slightly less than the diameter of the ram. When actuated, the lining material contacts the ram with sufficient frictional force to stop the downward motion of the ram without deformation of the ram. The rest of the mechanism is comprised of buttress members, pivot pins, and a base plate, mounted above a spacer ring. The spacer ring is the same diameter as the cylinder and is variable in length to raise the base plate and brake assembly above any bolts or other existing projections. Eyelets are welded to the existing cylinder to provide for secure mounting and correct alignment and realignment when the brake is removed and reinstalled.

The brake arms may be actuated mechanically by loss of hydraulic pressure, by an electronic signal from a hydraulic pressure detector, by down overspeed or by an uncontrolled down motion detector.

The force applied by the braking action is transferred from the brake arms through the base plate and spacer ring onto the circumferential area of the top of the main cylinder and any associated support structures. By monitoring the pressure and overspeed, the fall of the elevator can be limited to speeds with a maximum of less than twice the normal down speed, thus limiting the kinetic energy produced, by not allowing a free falling elevator. Therefore, the pit structure would absorb the energy with damage of deformation, without any modifications to the pit structure.

These and other objects and advantages of the invention will no doubt occur to those skilled in the art upon reading and understanding the following detailed description along with the accompanying drawings.

The term "accretable" is used in its conventional sense, meaning that the friction material is able to accrete to or to adhere to the surface of the ram.

DESCRIPTION OF THE PREFERRED EMBODIMENT

The drawings show a safety brake system according to the present invention, indicated generally by the reference number 1. Although the brake system 1 is applicable to many hydraulic ram or piston devices, it is described here in its preferred use on a hydraulic ram lifting elevator. References to "up", "down", "vertical", "horizontal", etc. should be understood to refer generally to the relative positions of the components of the illustrated device, which could be otherwise oriented or positioned for non-elevator applications. Further, although the term "hydraulic" is used, this invention could be used on any device with a similar configuration, i.e. a main cylinder which surrounds a second cylinder. References to "hydraulic" should be understood to refer generally to any pressure ram device including but not limited to hydraulic and pneumatic ram devices.

Figure 1:
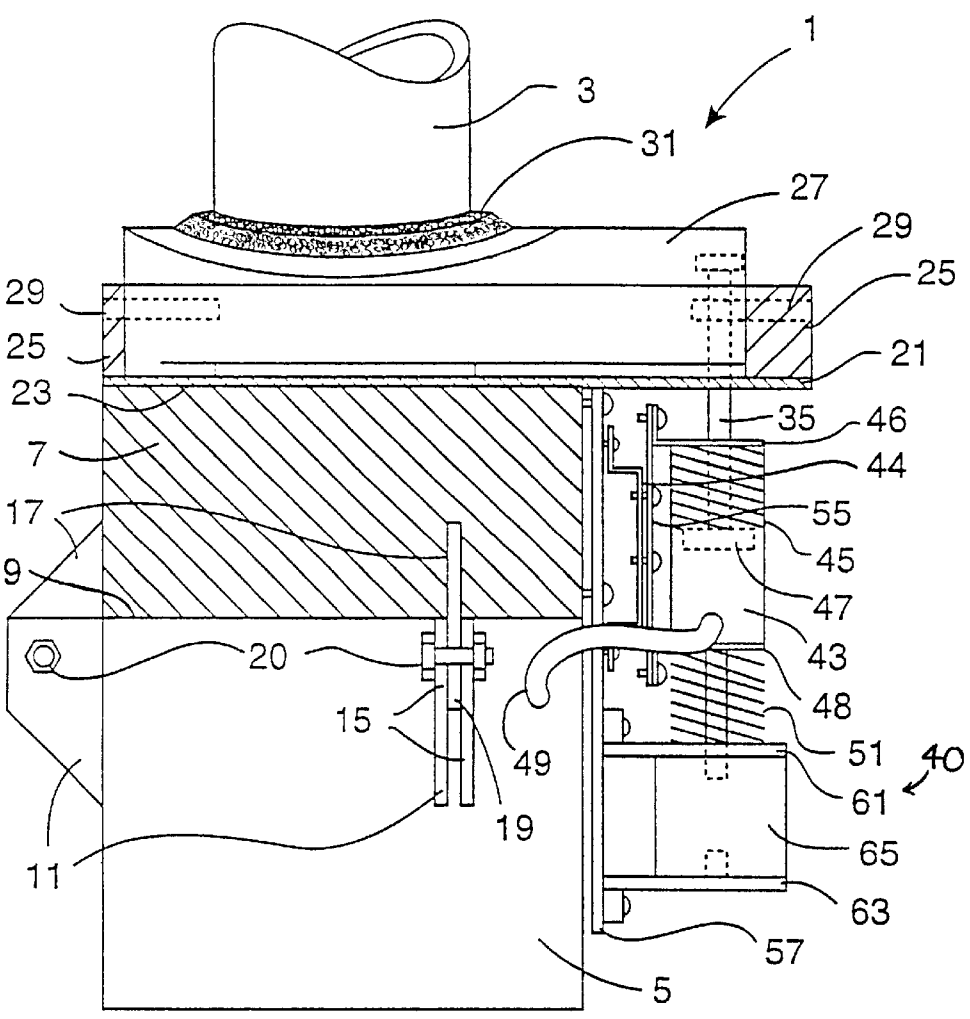
FIG. 1 is a side elevation view showing the brake and control components according to the invention.

In FIG. 1, a reciprocal piston or ram 3 is shown with brake system 1 installed on the existing main cylinder 5. Spacer ring 7 rests upon the upper end of main cylinder 5 at 9 and is removably fixed to upper end of main cylinder 5 by any one of a number of known fastening means. In a preferred embodiment, the known fastening means comprises eyelets 11 fixed to the outside surface of main cylinder 5 and near the upper end 9 of main cylinder 5. Each eyelet comprises a pair of flange 15 spaced a short distance apart, and flanges 17 on spacer ring 7 fit in between flange 15 of eyelets 11. Flanges 17 and flange 15 have bolt holes 19 which are aligned to accept eyelet bolts 20 to fix spacer ring 7 to main cylinder 5. In an alternate embodiment, eyelets 11 may comprise only a single flange. The advantage of using eyelets 11 is that any one of eyelets 11 can act as a pivot to rotate brake system 1 away from main cylinder 5 to allow access for servicing when eyelet bolts 20 are removed from the other eyelets 11. Removal of all eyelet bolts would allow total removal of brake system 1 for major work. Eyelets 11 also allow for exact reattachment of the device assuring proper alignment.

Base plate 21 is fixed to the upper surface of spacer ring 7 at 23. Buttress members 25 are fixed to base plate 21 on either side of brake arms 27. In the preferred embodiment, brake arms 27 are hingably fixed to buttress members 25 by pivot bolts 29 allowing brake arms 27 to rotate into or out of contact with ram 3.

Figure 2:
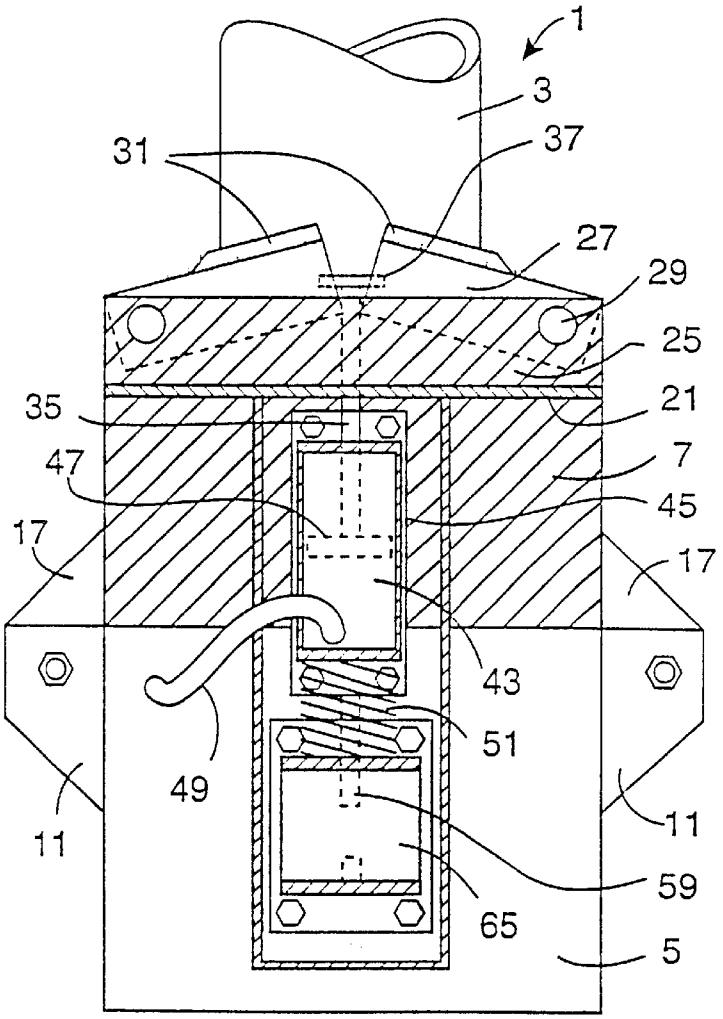
FIG. 2 is the front elevation view showing the brake and control components according to the invention.

In ready or standby position, brake arms 27 are raised 15 degrees from horizontal, allowing travel clearance of ram 3, best seen in FIG. 2. Brake arms 27 are shaped having semicircular cut-outs 26, best seen in FIG. 4, of diameter slightly larger than ram 3, and having a friction material mounting surface 28 on the inside of cutouts 26, best seen in FIG. 3. An accretable friction material 31 is fixed to the friction material mounting surfaces 28 of half circular cut-outs 26 of brake arms 27. In a preferred embodiment the accretable material 31 is annealed copper, but other materials may be used. Annealed copper is preferred because, of the materials tested, it has the greatest tendency to adhere to the ram 3. This maximizes the amount of friction between the ram 3 and the brake lining 31, which creates the greatest braking force with the least amount of damage/deformation of the ram 3 and the braking system 1. The inside diameter of the accretable friction material 31 is slightly smaller than the outside diameter of the ram 3. This provides proper engagement with ram 3 to bring the elevator to a halt.

Although the preferred embodiment uses two brake arms 27, a multiplicity of brake arms could be used. Each of the segments would form a section of the ring around the ram 3. These sections could be equal in size, or they could be disparate, if desired. Different sized sections could be advantageous in some situations, including where the configuration of the work space makes installation or maintenance easier if a certain portion of the brake system 1 is more articulated.

In an alternate brake arm embodiment, not shown, cutting bits or teeth may be fixed to the friction material mounting surface 28 of brake arms 27 in place of or in addition to accretable friction material 31. In this alternate embodiment, braking is accomplished by the teeth biting into ram 3. Unlike the hourglassing damage caused by the prior art, the type of damage caused by this alternate embodiment can be repaired by filling and filing the gouges.

Other systems for hingly fixing brake arms 27 to buttress members 25 are possible.

In an alternate hinge embodiment, hinge bolts may be used. In the hinged bolt embodiment, not shown, the rear side of brake arms 27 opposite the semicircular cut-outs 26 are oriented against buttress members 25 rather than lying between them as in the preferred embodiment. Brake arms 27 are spaced from buttress members 25 a distance sufficient for brake arms 27 to be rotated upwardly 15 degrees from horizontal. A plurality of hinge bolts pass through holes in buttress member 25 into the rear edge of brake arms 27 and are threadably fixed thereto. Bending of the hinge bolts allows pivotal motion of brake arms 27.

In another alternate hinge embodiment, also not shown, a slide hinge may be used. In this alternate embodiment, the side of brake arms 27 opposite the side nearest ram 3 are, again, oriented against buttress members 25 rather than lying between them. Buttress member 25 has a concave channel to partially receive the rear edge of brake arms 27, and the rear edge of brake arm 27 is rounded to fit the concave surface of buttress members 25. During pivotal movement of brake arms 27 the rounded rear edges of brake arms 27 slide within the concave surface of buttress member 25.

Figure 3:
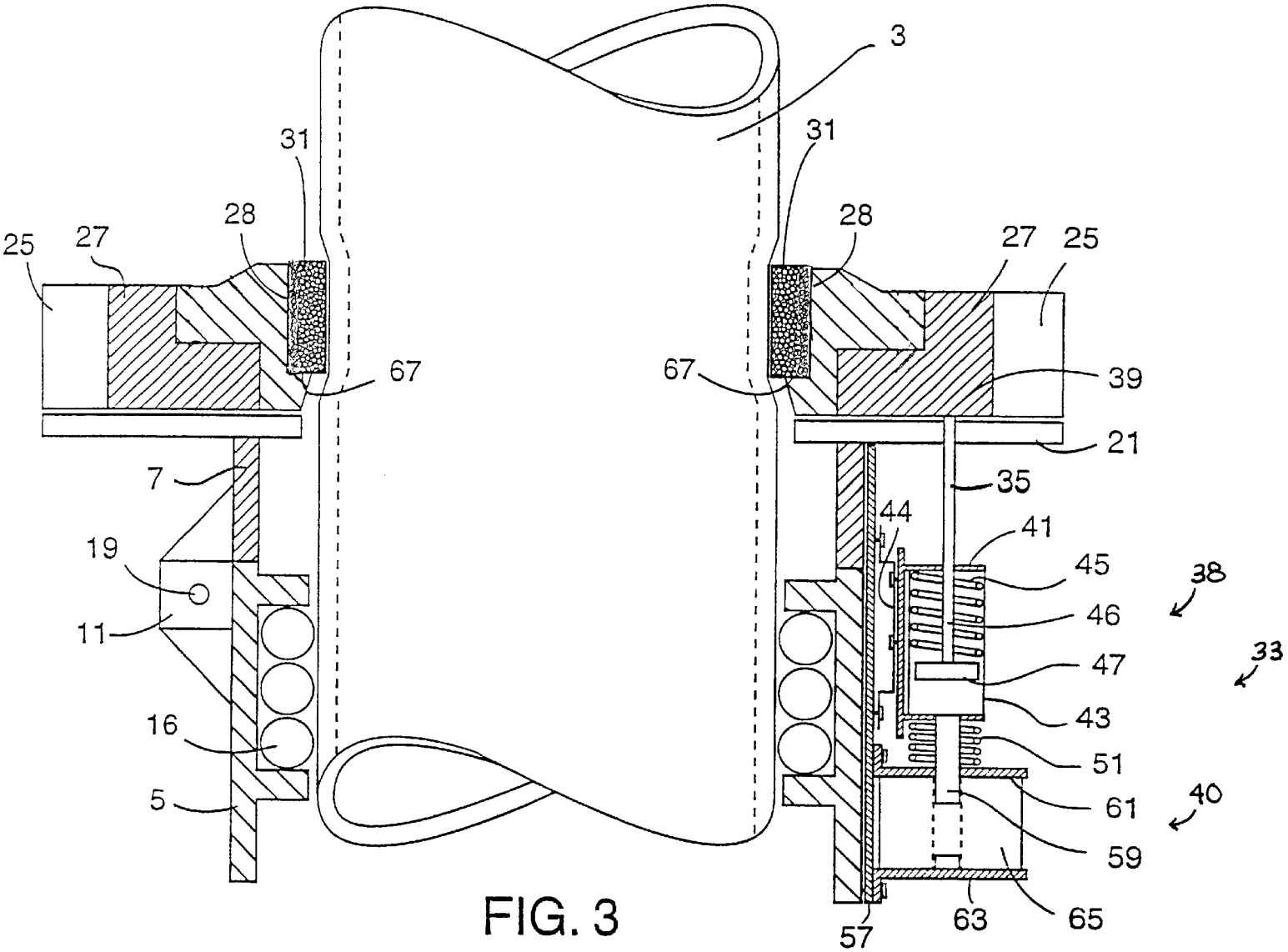
FIG. 3 is a sectional view showing the frictional contact, and locations of the packing in relation to the invention, as viewed along the line A—A in FIG. 4.
Figure 4:
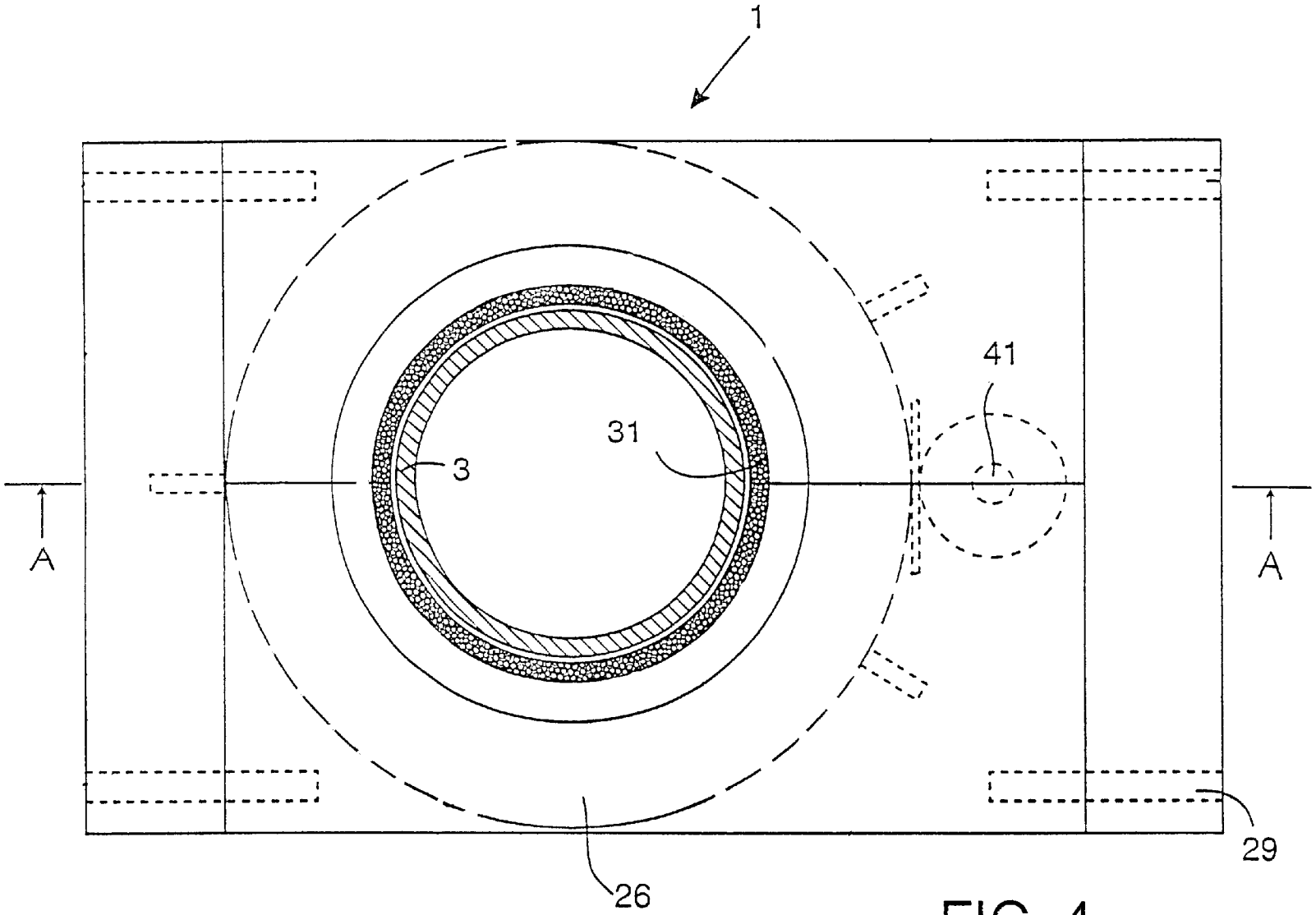
FIG. 4 is a plan view of the invention, as viewed along the line 1—1.

FIG. 3 shows the brake system 1 in actuated position. Accretable friction material 31 is in contact circumferentially with ram 3. Further travel downward by brake arms 27 is prevented by contact with base plate 21. Spacer ring 7 transfers kinetic energy from the brake arms 27 and base plate 21 onto the main cylinder 5 or any associated support structure which may exist. Eyelets 11 and the structural strength of spacer ring 7 prevent brake system 1 from slipping and assure equal transfer of force directly downward, into existing main cylinder 5 or onto any associated cylinder support structures. Kinetic energies can be limited by limiting the down speed allowed before brake system 1 is actuated, thereby preventing damage to the brake system 1, ram 3 or to the main cylinder 5.

In the preferred embodiment, brake system 1 is actuated by loss of hydraulic pressure detected by direct feedback from the main cylinder 5, by an electronic signal indicating loss of pressure in the cylinder 5, by electronic signal from a down overspeed, or by an uncontrolled down motion detector.

Brake system 1 is actuated by downward motion of actuation rod 35 attached to the actuation assembly, generally identified by 33. The top of the actuation rod 35 has a disc shaped metal wafer 37 that is received inside shaped hollows or routs 39 in the brake arms 27. This assures registration between both brake arms.

Hydraulic actuation of brake arms 27 is accomplished by the hydraulic actuation assembly, generally referenced by the number 38. The hydraulic actuation assembly 38 is located in and around feedback control cylinder 43 which is fixed between upper hydraulic cylinder bracket arm 46 and lower hydraulic cylinder bracket arm 48 of hydraulic cylinder bracket 55, both bracket arms 46, 48 being fixed to hydraulic cylinder bracket 55. The hydraulic actuation assembly 38 comprises feedback cylinder 43 having portal 41 to receive the lower end 46 of actuation rod 35, plunger 47 fixed to the lower end 46 of actuation rod 47, and helical compression spring 45 which is engaged over and around the lower end 47 of actuation rod 35, one end of compression spring 45 engaging the inside surface of the top of feedback cylinder 43 and the other end engaging plunger 47.

Helical compression return spring 45 urges plunger 47, and actuation rod 35 fixed thereto, downward. Under normal conditions, hydraulic pressure in feedback cylinder 43, in fluid communication with main cylinder 5, overcomes the compressed spring energy of return spring 45, urging plunger 47 upward, which in turn urges control rod 35 upward, which then urges brake arms 27 into ready or standby position.

Loss of hydraulic pressure in the main cylinder 5, is communicated to feedback cylinder 43 through hose 49 (FIGS. 1 and 2). Return spring 45 overcomes the reduced pressure in feedback cylinder 43 urging plunger 47 and attached actuation rod 35 downward pulling brake arms 27 into contact with ram 3. Friction resulting from contact of accretable material 31 on the friction material mounting surface 28 of brake arms 27 urges brake arms 27 further downward into contact with ram 3 until brake arms 27 rest on horizontal base plate 21. The accretable friction material 31 on brake arms 27 grips ram 3 with sufficient frictional force to stop the downward motion of ram 3.

Electronic actuation of brake arms 27 is accomplished by the electronic control assembly generally referenced by the number 40 comprising control bracket 57 fixed to spacer ring 7, upper solenoid bracket arm 61, and lower solenoid bracket arm 63, both being fixed to control bracket 57. Electronic actuation assembly 40 further comprises, electronic activator rod 59, and helical compression support spring 51 placed over and around electronic actuation control rod 59, the upper end of support spring 51 engaging lower surface of hydraulic control assembly 38, and the lower end of support spring 51 engaging the upper surface 51 of solenoid bracket 61.

In the preferred embodiment, electronic activator rod 59 is fixed at its upper end, generally, to the hydraulic actuation assembly 38, which is slidably engaged with slide bracket 44, slide bracket 44 being fixed to control bracket 57.

Solenoid helical compression support spring 51, is selected to support the weight of brake arms 27 and hydraulic actuation assembly 38. Tubular solenoid 65 is fixed between upper and lower solenoid bracket arms 61 and 63. The lower end of electronic actuation rod 59 partially penetrates tubular solenoid 65. The upper end of electronic actuation rod 59 is coupled to the underside of lower hydraulic cylinder bracket arm 48 of hydraulic cylinder bracket 55. An electronic signal from a down overspeed detector or uncontrolled downward motion detector, not shown, causes an electric current in solenoid 65 generating a magnetic field of strength sufficient to urge electronic actuation rod 59 downward into tubular solenoid 65, thereby pulling the entire hydraulic actuation assembly 38, slidably engaged to slide bracket 44, downward thereby actuating brake arms 31.

In an alternate embodiment, not shown, the electrical actuation assembly 40 is the same as described above, except no hydraulic actuation assembly 38 is used. Instead, electronic actuation rod 59 is engaged directly with brake arms 27. In this alternate embodiment, an electronic signal from a hydraulic pressure detector could also be used to actuate electronic actuation assembly 40, in addition to a down overspeed or uncontrolled downward motion detector.

A variety of known down overspeed or uncontrolled downward motion detectors are available for use with this invention. For example, devices such as those disclosed in Coy, U.S. Pat. No. 4,638,888 which discloses an electronic system for detecting the hydraulic pressure in an elevator ram piston cylinder, and Ericson, U.S. Pat. No. 5,052,523 and Sobat, U.S. Pat. No. 3,942,607, which both disclose mechanical means for detecting the downward speed of an elevator. The specifications of these patents are hereby incorporated by reference in their entirety.

Given the generally small distance from the bottom of a standard hydraulic lift elevator to the top of the existing piston cylinder structure, a low profile device is desirable. The present device, in ready position is between four and five inches high. This is accomplished by keeping the fulcrum angle at 15 degrees as shown in the drawings, best seen in FIGS. 1 and 2. Therefore, it is easily mounted onto all existing elevator cylinders.

Packing 16 is shown in FIG. 3 for illustrative purposes only, and varies from elevator to elevator depending on the manufacturer. The length of spacer ring 7 is dependent on the packing mechanism used by the various makes.

In general, the packing of all rams is located in the cylinder head at the top of the cylinder. The packing is the seal which retains the oil pressure and allows the smooth ram wall to slide relatively freely through it. Generally, there is some bypass of oil through this seal. When this bypassed oil is excessive it is customary to change the packing. As common as this procedure is, it is desirable to allow easy and open access to the cylinder head. As explained previously, the present invention utilizes a three point eyelet mounting. Any one of eyelets 11 can act as a pivot to rotate brake system 1 away from main cylinder 5 to allow access for servicing. By assuring enough range of motion by having a feedback hose 49 and electrical wiring of sufficient length, the device is easily rotated for access to packing 16 without the need to disconnect electrical wiring or hydraulic connections.

National, state and local codes provide regulations for periodic testing of safety devices, so it is desirable to retest without damaging either the ram or the brake. Prototype testing to date has shown less than twenty thousandths of fin inch deformation of the annealed copper at the open edges of the annealed copper bar, where the brakes meet centrally when closed, and no deformation elsewhere. Thus periodic testing is available, and the common practice of blocking the elevator to serve as a stable working platform is easily done by manually setting the brake.

The preferred embodiment described herein is illustrative only and although the examples given include many specificities, they are intended as illustrative of only one possible embodiment of the invention. Other embodiments and modifications will, no doubt, occur to those skilled in the art. Thus, the examples given should only be interpreted as illustrations of some of the preferred embodiments of the invention, and the full scope of the invention should be determined by the appended claims and their legal equivalents.

I claim:

1. An arresting device for halting relative motion between a main cylinder and a second cylinder of a hydraulic elevator, wherein the second cylinder moves within the main cylinder, wherein the second cylinder has a perimeter and an external radius of curvature, said arresting device comprising:

two lever arms, each of said two lever arms having an approximately semi-cylindrical braking surface and a pivot point, said approximately semi-cylindrical braking surface having an internal radius of curvature which is smaller than the external radius of curvature of the second cylinder, and said pivot point being offset from said braking surface, said lever arms having a first position wherein said lever arms are capable of being rotated away from the second cylinder with said braking surface out of contact with the perimeter of the second cylinder, and a second position wherein said lever arms are capable of pressing said braking surface against the perimeter of the second cylinder to generate a braking force.

2. The device of claim 1 wherein said first position is a rotation of 15 degrees from said second position.

3. The device of claim 1 wherein said braking surface is formed of an accretable material.

4. The device of claim 1 wherein said braking surface is formed of annealed copper.

5. The device of claim 1 further comprising at least one buttress member, said lever arms being pivotally attached to said at least one buttress member at said pivot point, wherein, when said lever arms are in said second position, said lever arms are configured to transmit a force from said buttress member to said braking surface to generate a braking force against the second cylinder.

6. The device of claim 1 further comprising a detection system for detecting an emergency situation, said detection system being in communication with an actuation means for moving said plurality of lever arms from said first position to said second position when said detection system detects the emergency situation.

7. The device of claim 1 wherein the main cylinder has a top surface, and wherein said lever arms are configured to be detachably attached adjacent the top surface of the main cylinder.

8. The device of claim 1 farther comprising an attachment configured for attaching said lever arms to the main cylinder, said attachment comprising a plurality of first flanges configured to be affixed to the main cylinder and having bolt holes for attachment to a plurality of second flanges affixed to a spacer ring, and wherein said lever arms are located above said spacer ring.

9. The device of claim 1 further comprising a base plate, said base plate configured to be located between the main cylinder and said lever arms, and wherein, when said lever arms are in said second position, said lever arms are parallel to and in contact with said base plate.

10. The device of claim 6 wherein said detection system detects an emergency situation chosen from the group consisting of a loss of hydraulic pressure, an overspeed condition, and an uncontrolled motion of said second cylinder.

11. The device of claim 1 further comprising a base plate and a buttress, said base plate configured to be located between the main cylinder and said lever arms, and said buttress being attached to said base plate adjacent said lever arms.

12. An arresting device for halting relative axial motion between a hydraulic cylinder and a ram of a hydraulic elevator, wherein the ram moves within the hydraulic cylinder, wherein the ram has an exterior surface and an external radius of curvature, said arresting device comprising:

two lever arms, each of said two lever arms having an approximately semi-cylindrical braking surface and a pivot point, said approximately semi-cylindrical braking surface having an internal radius of curvature which is smaller than the external radius of curvature of the ram, and said pivot point being offset from said braking surface, said lever arms having a first position wherein said lever arms are capable of being rotated away from the ram, and a second position wherein said lever arms are capable of pressing said braking surface against the exterior surface of the ram to generate a braking force, and a detection system for detecting an emergency situation, said detection system being in communication with said lever arms, whereby when said detection system detects an emergency situation said lever arms is moved from said first position to said second position.

13. The device of claim 1 wherein the second cylinder has a longitudinal axis and wherein said lever arms are configured such that, when said lever arms are in said second position, said lever arms are less than approximately 15 degrees from perpendicular to the longitudinal axis of the second cylinder.

14. The device of claim 1 wherein the second cylinder has a longitudinal axis and wherein said lever arms are configured such that, when said lever arms are in said second position, said lever arms are approximately perpendicular to the longitudinal axis of the second cylinder.

15. The device of claim 14 further comprising a base plate, said base plate being positioned to stop further rotation of said lever arms when said lever arms are in said second position.

16. The device of claim 1 wherein the second cylinder has a longitudinal axis and wherein each of said lever arms are configured to have an axis of rotation passing through said pivot point which is approximately perpendicular to and offset from the longitudinal axis of the second cylinder.

* * * * *